US007677573B2

(12) United States Patent
Webb

(10) Patent No.: US 7,677,573 B2
(45) Date of Patent: Mar. 16, 2010

(54) HOLD'EM TABLE GAME

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 318 days.

(21) Appl. No.: 11/376,238

(22) Filed: Mar. 16, 2006

(65) Prior Publication Data

US 2007/0216097 A1 Sep. 20, 2007

(51) Int. Cl.
*A63F 1/00* (2006.01)

(52) U.S. Cl. ..... 273/292; 273/274; 273/273; 463/14; 463/15

(58) Field of Classification Search ..... 273/292
See application file for complete search history.

(56) References Cited

U.S. PATENT DOCUMENTS 5,265,882 A 11/1993 Malek
5,328,189 A 7/1994 Malek
5,395,120 A 3/1995 Malek
5,407,199 A 4/1995 Gumina
5,494,296 A 2/1996 Grassa
5,531,448 A 7/1996 Moody
5,639,092 A 6/1997 Macaisa
5,653,444 A 8/1997 Dahl
5,678,821 A 10/1997 Hedman
5,839,732 A 11/1998 Guidi
5,868,392 A 2/1999 Kraft
5,868,618 A 2/1999 Netley et al.
5,897,436 A 4/1999 Singer et al.
5,901,958 A 5/1999 Andrews
5,975,529 A 11/1999 de Keller
5,988,643 A 11/1999 Awada
6,019,374 A 2/2000 Breeding
6,070,873 A 6/2000 Perkins
6,113,102 A 9/2000 Marks et al.
6,131,908 A 10/2000 Palmer
6,158,741 A 12/2000 Koelling
6,182,969 B1 2/2001 Green
6,206,375 B1 3/2001 Wichinsky
6,227,969 B1 5/2001 Yoseloff
6,334,614 B1 1/2002 Breeding
6,503,145 B1 1/2003 Webb
2003/0027614 A1 2/2003 Webb
2005/0082755 A1 * 4/2005 Snow ..... 273/273
2005/0104293 A1 5/2005 Webb
2005/0107148 A1 5/2005 Webb
2005/0242506 A1 * 11/2005 Yoseloff ..... 273/292
2006/0027968 A1 * 2/2006 Snow ..... 273/292
2006/0284376 A1 * 12/2006 Snow ..... 273/292
2007/0066376 A1 3/2007 Webb

* cited by examiner

*Primary Examiner*—Gene Kim
*Assistant Examiner*—Michael D Dennis
(74) *Attorney, Agent, or Firm*—Nixon & Vanderhye P.C.

(57) ABSTRACT

A method of playing a house-banked casino card game includes dealing player cards to a player, dealer cards to a dealer, and community cards to form a player hand and a dealer hand. The players are provided with options to place wagers, wherein a number of placed wagers in play is determined according to a rank of the dealer hand. Moreover, not all wagers are required for the player to stay in the game.

14 Claims, 1 Drawing Sheet

HOLD'EM TABLE GAME

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to a house-banked casino card game and, more particularly, to a house-banked casino card game that emulates a conventional Texas Hold'Em game in a player versus dealer format.

Texas Hold'Em has become popular over the last several years due to its simplicity, the ability to accommodate a higher number of players per table, and televised coverage. The game is played so that each player has the use of seven cards in order to form a five card poker hand. The player having the highest poker hand is the game winner. Hands are ranked in standard poker fashion, i.e. royal flush, straight flush, four of a kind, full house, flush, straight, three of a kind, two pair, one pair, and high card, in descending order.

In Texas Hold'Em each player receives two cards face down. Additionally, there are five community cards dealt face up. The term "community card" refers to a non-player specific card that is exposed (face up) and available for use by any of the players in order to form a poker hand. Each player is enabled to use seven cards (i.e. the two concealed cards held by the player, plus the five community cards that are available to each player).

In Texas Hold'Em, the cards are dealt sequentially so that each player initially receives two cards face down, after which the five community cards are dealt face up. Rounds of betting occur at certain times during the course of play, usually after the two face down cards have been dealt, then after the third community card has been dealt, then after the fourth community card has been dealt, and finally after the fifth community card has been dealt. Thus, there are four rounds of betting (in addition to an ante prior to the cards being dealt).

There have been many attempts to derive a house-banked Texas Hold'Em game for casino play, some of which include Casino Hold'Em, Wild Hold'Em Fold'Em, Big Raise Hold'Em, Colorado Hold'Em, All-In Hold'Em, Fast Action Hold'Em, Texas Bonus Hold'Em and Ultimate Texas Hold'Em. There are also other games using some aspect of Hold'Em, namely High Country Poker, Texas Shoot Out and Flip Flop Poker. Virtually all of these games are essentially games where the competition wagers on a player hand are against the dealer house hand. Only three of these games, Texas Bonus Hold'Em, Casino Hold'Em and All-In Hold'Em include the aspect of all community cards being dealt as in Hold'Em, with at least one bet option during play. Flip Flop Poker allows one optional wager of a fixed amount based on player hand against other player hands In actual card room Hold'Em, all player wagers are against other players. Players use skills of poker judgment to determine whether to remain in the game at each betting round. Ultimately, one player wins the pot, unless there is a split pot based on equal hands.

To transform Hold'Em into a house banked casino game is not easy. Firstly, when casino games incorporate skill levels, then experienced players minimize the house advantage, whereas inexperienced players suffer a higher house advantage due to their inferior play. An obvious example is Blackjack, a game that very skilled players are able to actually win at, although the majority of players lose significantly more than they should if they just applied basic correct strategy. A new game should minimize the skill factor in order to have maximum appeal to the maximum number of players.

Secondly, a casino game is more attractive to more players if there are multiple simultaneous winners. This possibility is excluded in card room Hold'Em. A viable player versus dealer format would be a suitable solution.

BRIEF SUMMARY OF THE INVENTION

It would be desirable to provide a house-banked Hold'Em game for casino play that overcomes the drawbacks with prior games. It would also be desirable to provide a game incorporating four optional betting rounds to be more akin to the conventional card room game. However, it would be desirable to provide such a game that enables players to stay in the game regardless of their hand value, without fold or bet requirements.

The innovative method of the present invention emulates card room play of a conventional Hold'Em game in a player versus dealer format. In order to establish an appropriate house advantage, which is required for casino viability, although the player after placing an Ante to participate in the game can place additional wagers at their option as a Play wager after receiving their hole cards, a Flop wager after three community cards have been dealt, a Turn wager after a fourth community card has been dealt, and a River wager after a fifth community card has been dealt, the additional wagers may only be "in play" if the dealer hand has a specified hand rank.

In an exemplary embodiment of the invention, a method of playing a house-banked casino card game includes the steps of (a) receiving an Ante wager from a player; (b) dealing at least one player card to the player and at least one dealer card to a dealer; (c) providing the player with an option to place a Play wager, wherein the Play wager is not required for the player to stay in the game; (d) dealing at least one community card, wherein a player hand includes cards selected from the at least one player card and the at least one community card, and wherein the dealer hand includes cards selected from the at least one dealer card and the at least one community card; and (e) resolving the Ante wager and the Play wager if placed according to a rank of the player hand versus a rank of the dealer hand. A house advantage may be adjusted by setting rules for practicing step (e) when the player hand rank and the dealer hand rank are equal.

In one playing mode, after step (d), the method includes (d-1) providing the player with an option to place a subsequent wager, wherein the subsequent wager is not required for the player to stay in the game, and (d-2) dealing at least one subsequent community card. In this context, a player hand includes cards selected from the at least one player card, the at least one community card and the at least one subsequent community card, and the dealer hand includes cards selected from the at least one dealer card, the at least one community card, and the at least one subsequent community card. The method may further include the step of repeating steps (d-1) and (d-2), where the player hand consists of five cards selected from the at least one player card and the subsequent community cards. In this context, step (e) may be practiced by resolving the Ante wager, the Play wager if placed and subsequent wagers if placed according to the rank of the player hand versus the rank of the dealer hand, where the number of the subsequent wagers in play is determined according to the rank of the dealer hand.

The method may additionally include receiving a proposition wager from the player, and after step (d), resolving the proposition wager according to a poker rank of the player hand. The step of receiving the proposition wager may be practiced after step (b).

In another exemplary embodiment of the invention, a method of playing a house-banked casino card game includes the steps of (a) receiving an Ante wager from a player; (b) dealing at least one player card to the player and at least one dealer card to a dealer; (c) alternately providing the player with an option to place a subsequent wager and dealing at least one community card; (d) repeating step (c) until a predetermined number of wager options have been provided to the player and a predetermined number of community cards have been dealt, wherein a player hand includes cards selected from the at least one player card and at least one of the predetermined number of community cards, and wherein the dealer hand includes cards selected from the at least one dealer card and at least one of the predetermined number of community cards; and (e) resolving the Ante wager and all subsequent wagers according to a rank of the player hand versus a rank of the dealer hand, wherein the number of the subsequent wagers in play is determined according to the rank of the dealer hand.

In one playing mode, the player hand consists of five cards selected from the at least one player card and the predetermined number of community cards, and the dealer hand consists of five cards selected from the at least one dealer card and the predetermined number of community cards. With the Ante wager and the subsequent wagers, the player is provided with options to place five wagers. The number of the five wagers in play is determined according to the dealer hand poker rank as:

| DEALER HAND RANK | PLAYS AGAINST |
|---|---|
| straight or better | five wagers |
| three of a kind | four wagers |
| two pair | three wagers |
| one pair | two wagers |
| all hands | one wager |

The number of the subsequent wagers in play may be additionally determined according to which of the five wagers have been placed, such as whether the player placed a second of the five wagers such that in order for all wagers to be in play when the dealer hand plays against two wagers or more, the second wager must have been placed.

In an alternative playing mode, the number of the five wagers in play is determined according to the dealer hand poker rank as:

| DEALER HAND RANK | PLAYS AGAINST |
|---|---|
| three of a kind or better | five wagers |
| two pair | four wagers |
| one pair | three wagers |
| all hands | two wagers |

In one operating mode, the step of receiving the proposition wager from the player requires that the player place a second of the five wagers.

In still another exemplary embodiment of the invention, a method of playing a house banked casino card game includes the steps of (a) receiving an Ante wager from a player; (b) dealing two player cards to the player and two dealer cards to a dealer; (c) providing the player with an option to place a Play wager, wherein the Play wager is not required for the player to stay in the game; (d) dealing first, second and third community cards; (e) providing the player with an option to place a Flop wager, wherein the Flop wager is not required for the player to stay in the game; (f) dealing a fourth community card; (g) providing the player with an option to place a Turn wager, wherein the Turn wager is not required for the player to stay in the game; (h) dealing a fifth community card, wherein a player hand consists of five cards selected from the two player cards and the first through fifth community cards, and wherein the dealer hand consists of five cards selected from the two dealer cards and the first through fifth community card; (i) providing the player with an option to place a River wager, wherein the River wager is not required for the player to stay in the game; (j) determining which of the Play wager, the Flop wager, the Turn wager and the River wager are in play based on a poker rank of the dealer hand; and (k) resolving the Ante wager, the Play wager, the Flop wager, the Turn wager and the River wager if placed according to which of the wagers are in play based on a poker rank of the player hand versus a poker rank of the dealer hand.

In yet another exemplary embodiment of the invention, a method of playing a house-banked casino card game comprises dealing player cards to a player, dealer cards to a dealer, and community cards to form a player hand and a dealer hand, and providing the player with options to place wagers, wherein a number of placed wagers in play is determined according to a rank of the dealer hand. In a still further exemplary embodiment of the invention, the method comprises dealing player cards to a player, dealer cards to a dealer, and community cards to form a player hand and a dealer hand, and providing the player with options to place wagers, wherein only one wager is required for the player to stay in the game.

BRIEF DESCRIPTION OF THE DRAWINGS

These and other aspects and advantages of the present invention will be described in detail with reference to the accompanying drawing, in which.

DETAILED DESCRIPTION OF THE INVENTION

Figure 1:
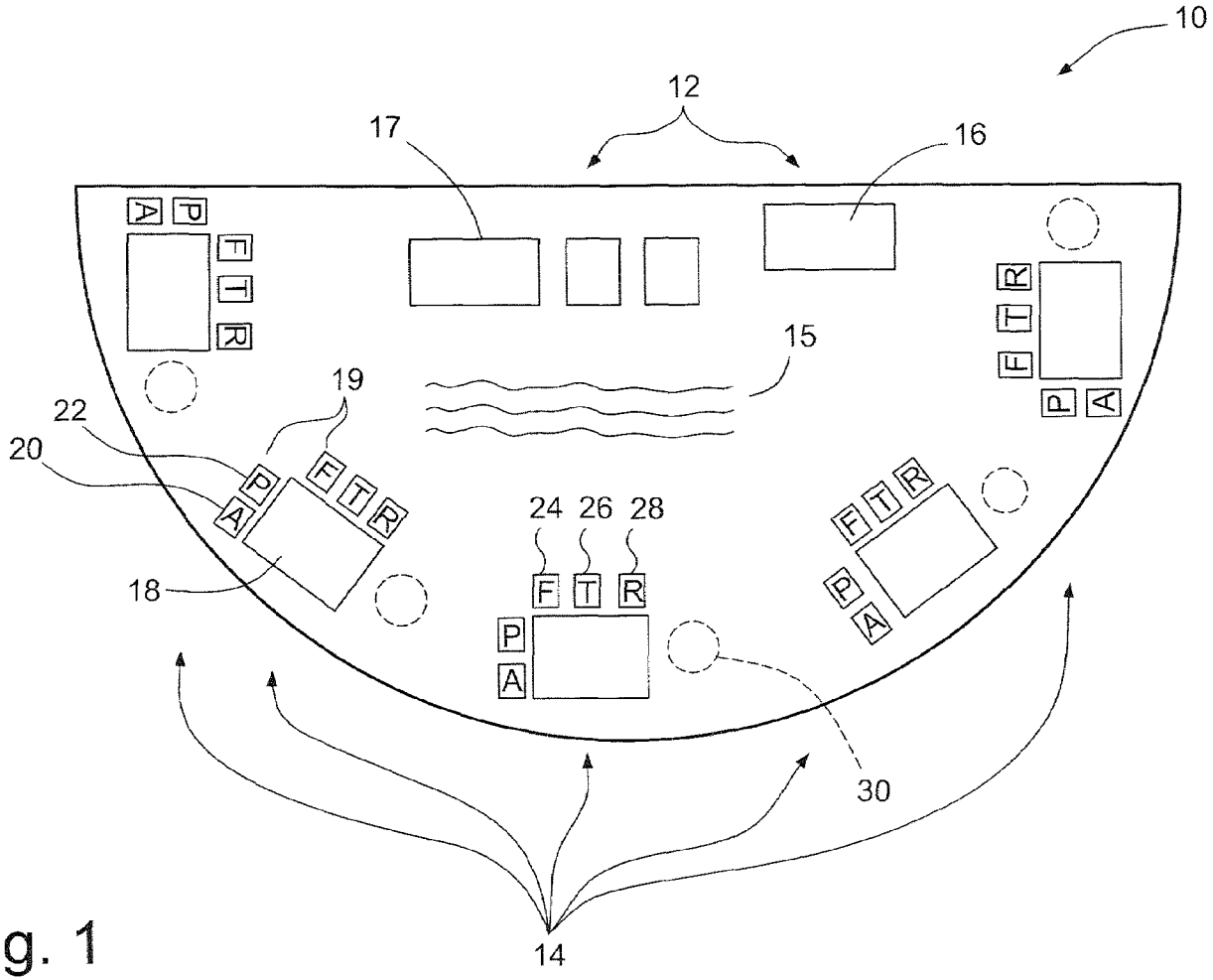
FIG. 1 illustrates an exemplary table layout for the game method according to the present invention.

FIG. 1 is a plan view of an exemplary layout 10 for the game method according to the present invention. The layout 10 includes a dealer area 12 and a plurality of player areas 14. Although FIG. 1 shows five player areas 14, more players can participate in the game at a time using a conventional 52-card deck of cards. In preferred embodiments, the table layout 10 may include between seven and ten player areas 14, although seven player areas 14 is most preferred.

The dealer area 12 lists rules of play and promotional information 15 and includes a dealer hand area 16 and a community card area 17. Each player area 14 includes a player hand area 18 and a wager area 19. The wager area 19 includes spaces for wagers including an Ante wager 20, a Play wager 22, a Flop wager 24, a Turn wager 26, and a River wager 28. An additional wager area 30 for a possible bonus wager or the like is shown in dashed line.

In a preferred operating mode, game play emulates the flow of card room Hold'Em. Each player is required to place an Ante wager at wager area 20 to participate in the game. The dealer then deals two player cards to each player at player card area 18 and two dealer cards to the dealer at dealer card area 16. The players are then provided with an option to place a Play wager at area 22. As noted, the Play wager is not required for the player to stay in the game. After the betting round is complete, the dealer deals first, second and third community cards at community card area 17. The players are provided with an option to place a Flop wager at area 24. The Flop wager is also not required for the players to stay in the game. This wager may be placed regardless of whether or not the player also placed the Play wager at area 22. A fourth community card is dealt at community card area 17, and players are provided with an option to place a Turn wager at wager area 26. The Turn wager is not required for the player to stay in the game. The dealer deals a fifth community card at community card area 17, and the players are provided with an option to place a River wager at wager area 28. Like the play, flop and turn wagers, the river wager is similarly not required for the player to stay in the game. Each of the Play, Flop, Turn and River wagers if placed is preferably equal to the Ante wager.

In this operating mode, the formation of a player hand and a dealer hand is the same as that in conventional Texas Hold'Em. That is, a player hand consists of five cards selected from the two player cards and the first through fifth community cards. Similarly, the dealer hand consists of five cards selected from the two dealer cards and the first through fifth community cards.

In order to control the house advantage, not all of the wagers placed at areas 20, 22, 24, 26 and 28 will be "in play" in every game. That is, even if the player wins a particular hand, certain ones of the wagers will not be paid but will rather be returned to the player. Prior to resovling the wagers, a determination is made as to which ones of the Play wager 22, the Flop wager 24, the Turn wager 26, and the River wager 28 are in play if any according to a rank of the dealer hand. In one playing mode, the determination is made according to:

| DEALER HAND RANK | PLAYS AGAINST |
|---|---|
| straight or better | five wagers |
| three of a kind | four wagers |
| two pair | three wagers |
| one pair | two wagers |
| all hands | one wager |

In an alternative playing mode, the determination is made according to:

| DEALER HAND RANK | PLAYS AGAINST |
|---|---|
| three of a kind or better | five wagers |
| two pair | four wagers |
| one pair | three wagers |
| all hands | two wagers |

If a player has placed a number of bets equal to or lower than the number of wagers "in play," then all bets will play. The wagers are resolved according to which of the wagers are in play based on a poker rank of the player hand versus a poker rank of the dealer hand. All winning wagers preferably pay 1 to 1. The house advantage may be adjusted by setting rules for resolving wagers when the player hand rank and the dealer hand rank are equal. For example, certain ties may be resolved as a win for the player, while other ties may be resolved as a push or a dealer win. Alternatively, all ties may be resolved as a win for the player or as a win for the dealer in order to create the preferred house advantage.

The players may also be provided with an option to place a proposition wager at area 30. The proposition or bonus wager 30 is a side wager that is paid out according to a preset scale based on the hand rank of the player hand. In one operating mode, the proposition wager 30 is placed prior to dealing any cards. In another operating mode, the option to place the proposition wager 30 may be provided after dealing the player cards. This playing mode may require the player to have placed the Play wager 22 in order to place the proposition wager 30. The proposition wager 30 is preferably equal to the other wagers. In this context, the pay scale for the operating mode where the option to place the proposition wager is provided after dealing the player cards may be different than the playing mode where the proposition wager 30 is placed prior to dealing the player cards.

Alternatively or additionally, the game may incorporate a bonus payout for premium hands such as straight or better regardless of whether the proposition wager 30 is part of the game. This payout may be on either the Ante wager or more preferably on the Play wager based on the rank of the player hand only or based on the rank of the player hand and whether the player hand beats the dealer hand.

In still other alternative playing modes, the number of the wagers in play may additionally be determined according to whether the player placed a particular one of the wagers. For example, the game may require that in order for all wagers to be in play when the dealer hand plays against two wagers or more, the Play wager must have been placed. This requirement adds to the house advantage.

As would be apparent to those skilled in the relevant art, the invention can be embodied in a wide variety and forms of media such as, but not limited to, single player slot video machines, multi-player slot video machines, electronic games and devices, lottery terminals, scratch-card formats, software, as well as in-flight, home and Internet entertainment. In addition, the invention can be readily implemented as a computer program product (e.g., floppy disk, compact disc, etc.) comprising a computer readable medium having control logic recorded therein to implement the features of the invention as described. Control logic can be loaded into the memory of a computer and executed by a central processing unit (CPU) to perform the operations described herein.

An exemplary apparatus configured for playing the game according to the invention may include a display, a player interface, and circuitry for effecting game play and including structure for receiving wagers and dealing hands according to the rules of the game. The processing circuit effects game play according to game rules and resolves wagers based on a comparison of the player hand to a computer dealer hand as well as possibly a payout scale.

With the game according to the present invention, a house-banked Hold'Em game is provided for casino play that mimics the conventional card room Hold'Em game. The game enables four optional betting rounds, none of which is required for the player to remain in the game. As such, a player can stay in the game regardless of hand value without a "fold or bet" requirement typical of previous attempts at a Hold'Em table game. Another novel aspect of the game is that the number of wagers in play is determined according to a rank of the dealer hand. This feature facilitates control of the house advantage thus improving casino viability.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of playing a house-banked casino card game, the method comprising:

(a) receiving an Ante wager from a player;

(b) dealing at least one player card to the player and at least one dealer card to a dealer using a table or at least one apparatus;

(c) providing the player with an option to place an additional competition wager and then dealing at least one community card;

(d) repeating step (c) until at least two additional competition wager options have been provided to the player and a predetermined number of community cards have been dealt, wherein a player hand includes cards selected from the at least one player card and at least one of the predetermined number of community cards, and wherein the dealer hand includes cards selected from the at least one dealer card and at least one of the predetermined number of community cards; and (e) resolving the Ante wager and all of the additional competition wagers according to a poker rank of the player hand versus a poker rank of the dealer hand, wherein the number of the additional competition wagers in play and at risk is determined according to the poker rank of the dealer hand such that if the dealer hand poker rank is less than one pair, only the Ante wager is in play and at risk, and if the dealer hand poker rank is one pair or better, the Ante wager and all of the additional competition wagers are in play and at risk, and wherein if the poker rank of the player hand exceeds the poker rank of the dealer hand, the Ante wager and all of the additional competition wagers are paid 1 to 1, wherein the player hand consists of five cards selected from the at least one player card and the predetermined number of community cards, and wherein the dealer hand consists of five cards selected from the at least one dealer card and the predetermined number of community cards, wherein with the Ante wager and the subsequent wagers, the player is provided with options to place five wagers, and wherein the number of the five wagers in play is determined according to the dealer hand poker rank as:

| DEALER HAND RANK | PLAYS AGAINST |
|---|---|
| straight or better | five wagers |
| three of a kind | four wagers |
| two pair | three wagers |
| one pair | two wagers |
| all hands | one wager. |

2. A method according to claim 1, wherein the number of the subsequent wagers in play is additionally determined according to whether the player placed a second of the five wagers such that in order for all wagers to be in play when the dealer hand plays against two wagers or more, the second wager must have been placed.

3. A method of playing a house-banked casino game, the method comprising:

(a) receiving an Ante wager from a player;

(b) dealing at least one player card to the player and at least one dealer card to a dealer using a table or at least one apparatus;

(c) alternately providing the player with an option to place a subsequent wager and dealing at least one community card;

(d) repeating step (c) until a predetermined number of wager options have been provided to the player and a predetermined number of community cards have been dealt, wherein a player hand includes cards selected from the at least one player card and at least one of the predetermined number of community cards, and wherein the dealer hand includes cards selected from the at least one dealer card and at least one of the predetermined number of community cards; and (e) resolving the Ante wager and all subsequent wagers according to a poker rank of the player hand versus a poker rank of the dealer hand, wherein the number of the subsequent wagers in play is determined according to the poker rank of the dealer hand, wherein the player hand consists of five cards selected from the at least one player card and the predetermined number of community cards, and wherein the dealer hand consists of five cards selected from the at least one dealer card and the predetermined number of community cards, wherein with the Ante wager and the subsequent wagers, the player is provided with options to place five wagers, and wherein the number of the five wagers in play is determined according to the dealer hand poker rank as:

| DEALER HAND RANK | PLAYS AGAINST |
|---|---|
| three of a kind or better | five wagers |
| two pair | four wagers |
| one pair | three wagers |
| all hands | two wagers. |

4. A method according to claim 3, wherein the number of the subsequent wagers in play is additionally determined according to whether the player placed a second of the five wagers such that all wagers are in play when the second wager has been placed.

5. A method according to claim 1, wherein the number of the subsequent wagers in play is additionally determined according to which of the subsequent wagers have been placed.

6. A method according to claim 1, further comprising receiving a proposition wager from the player, and after step (d), resolving the proposition wager according to a poker rank of the player hand.

7. A method according to claim 6, wherein step (b) is practiced by dealing two player cards to the player, wherein the player hand consists of five cards selected from two player cards and the predetermined number of community cards, wherein the dealer hand consists of five cards selected from the at least one dealer card and the predetermined number of community cards, wherein with the Ante wager and the subsequent wagers, the player is provided with options to place five wagers, and wherein the step of receiving the proposition wager is practiced after step (b).

8. A method according to claim 7, wherein the step of receiving the proposition wager from the player requires that the player place a second of the five wagers.

9. A method of playing a house banked casino card game, the method comprising:

(a) receiving an Ante wager from a player;

(b) dealing two player cards to the player and two dealer cards to a dealer using a table or at least one apparatus;

(c) providing the player with an option to place a Play wager, wherein the Play wager is not required for the player to stay in the game;

(d) dealing first, second and third community cards;

(e) providing the player with an option to place a Flop wager, wherein the Flop wager is not required for the player to stay in the game;

(f) dealing a fourth community card;

(g) providing the player with an option to place a Turn wager, wherein the Turn wager is not required for the player to stay in the game;

(h) dealing a fifth community card, wherein a player hand consists of five cards selected from the two player cards and the first through fifth community cards, and wherein the dealer hand consists of five cards selected from the two dealer cards and the first through fifth community card;

(i) providing the player with an option to place a River wager, wherein the River wager is not required for the player to stay in the game;

(j) determining which of the Play wager, the Flop wager, the Turn wager and the River wager are in play and at risk based on a poker rank of the dealer hand such that if the dealer hand poker rank is less than one pair, only the Ante wager is in play and at risk, and if the dealer hand poker rank is one pair or better, the Ante wager and at least one of the subsequent wagers are in play and at risk; and (k) resolving the Ante wager, the Play wager, the Flop wager, the Turn wager and the River wager if placed according to which of the wagers are in play based on a poker rank of the player hand versus a poker rank of the dealer hand, wherein if the dealer hand poker rank is one pair or better and if the player hand poker rank exceeds the dealer hand poker rank, the Ante wager, the Play wager, the Flop wager, the Turn wager and the River wager are paid 1 to 1, wherein step (j) is practiced according to:

| DEALER HAND RANK | PLAYS AGAINST |
|---|---|
| straight or better | five wagers |
| three of a kind | four wagers |
| two pair | three wagers |
| one pair | two wagers |
| all hands | one wager. |

10. A method according to claim 9, wherein a house advantage is adjusted by setting rules for practicing step (k) when the player hand rank and the dealer hand rank are equal.

11. A method according to claim 9, wherein step (j) is further practiced by determining which wagers are in play additionally according to whether the player placed the Play wager such that in order for all wagers to be in play when the dealer hand plays against two wagers or more according to the dealer hand rank, the Play wager must have been placed.

12. A method according to claim 9, further comprising receiving a proposition wager from the player, and after step (k), resolving the proposition wager according to a poker rank of the player hand.

13. A method according to claim 12, wherein the step of receiving the proposition wager is practiced after step (b).

14. A method according to claim 13, wherein the step of receiving the proposition wager from the player requires that the player place the Play wager.

* * * * *